US005873398A

United States Patent [19]

Svensson

[11] Patent Number: 5,873,398

[45] Date of Patent: Feb. 23, 1999

[54] DEBARKING DEVICE

[75] Inventor: Ake Svensson, Själevad, Sweden

[73] Assignee: BMH Wood Technology AB, Ornskoldsvik, Sweden

[21] Appl. No.: 849,635

[22] PCT Filed: Nov. 23, 1995

[86] PCT No.: PCT/SE95/01400

§ 371 Date: Aug. 1, 1997

§ 102(e) Date: Aug. 1, 1997

[87] PCT Pub. No.: WO96/15886

PCT Pub. Date: May 30, 1996

[30] Foreign Application Priority Data

Nov. 23, 1994 [SE] Sweden ..... 9404063

[51] Int. Cl.[6] ..... B27L 1/00

[52] U.S. Cl. ..... 144/208.9; 144/208.1; 144/341; 384/549; 241/178

[58] Field of Search ..... 144/208.1, 208.9, 144/341; 241/178; 384/125, 549

[56] References Cited

U.S. PATENT DOCUMENTS

| | | | |
|---|---|---|---|
| 2,858,177 | 10/1958 | Birdsall | 144/208.9 X |
| 3,262,477 | 7/1966 | O'Brien | 144/208.9 |
| 4,232,374 | 11/1980 | Kiriazdros | 144/208.9 X |
| 4,596,280 | 6/1986 | Svensson | 144/208.9 |
| 5,247,978 | 9/1993 | Silenius et al. | 144/208.9 X |

FOREIGN PATENT DOCUMENTS

91/17030 11/1991 WIPO .

*Primary Examiner*—W. Donald Bray

[57] ABSTRACT

A debarking device includes a drum having a radically outer peripheral surface, the drum being arranged to be rotated about a longitudinal axis. Two bogies, spaced from one another in the circumferential direction of said outer peripheral surface of said drum support the drum from a foundation. Each bogie includes a travelling wheel and a driving wheel, these being spaced from one another in the circumferential direction of the outer peripheral surface of the drum, and each journalled on respective axles for rotation about a respective axis which is substantially parallel to the longitudinal axis. A respective structure is interposed between each said bogie and the foundation, and supports the drum supported by the respective bogie on the foundation. Each structure includes three elastic elements each having a respective cushion. The cushions are located beside one another in the circumferential direction, with spacing therebetween, so as to include an intermediate cushion and two outer cushions. The intermediate cushions are more rigid than said intermediate cushion. Each structure further includes a plate arrangement supporting a respective bogie and being supported by the cushions of a respective three elastic elements.

6 Claims, 1 Drawing Sheet

DEBARKING DEVICE

This application is the national phase of international application PCT/SE95/01400, filed Nov. 23, 1995 which designated the U.S.

BACKGROUND OF THE INVENTION

This invention relates to a device in a barking unit, which comprises a barking drum which is placed on two bogies, positioned at a distance from each other, each bogie comprising a travelling wheel and a driving wheel, positioned at a distance from each other along the periphery of the barking drum, and being arranged in a foundation. (The purpose of a barking unit is to remove bark from logs or other pieces of wood having adhering bark. Sometimes the process involved is called "debarking", in which case the device can be called a debarking device.

This type of barking unit is previously known. The problem with known constructions has been the fastening of the bogies to the foundation and has resulted in operational disturbances in the barking unit.

SUMMARY OF THE INVENTION

This invention intends to remove the problems with known constructions and to provide a technical solution allowing the barking unit to be driven in a reliable way. This has been made possible by a device of the kind mentioned by way of introduction, which is characterized by the combination of the following features:

the bogie is resiliently arranged in the foundation by means of elastic elements;

the elastic elements comprise three cushions, positioned beside and at a distance from each other, the intermediate cushion being more rigid than the two outer cushions; and the elastic elements are intended to cooperate with a plate arrangement, which is arranged between the bogie and the fundament.

BRIEF DESCRIPTION OF THE DRAWING

A preferred embodiment of the invention shall be described more closely below with reference to the accompanying drawing, in which.

DETAILED DESCRIPTION

Figure 1:
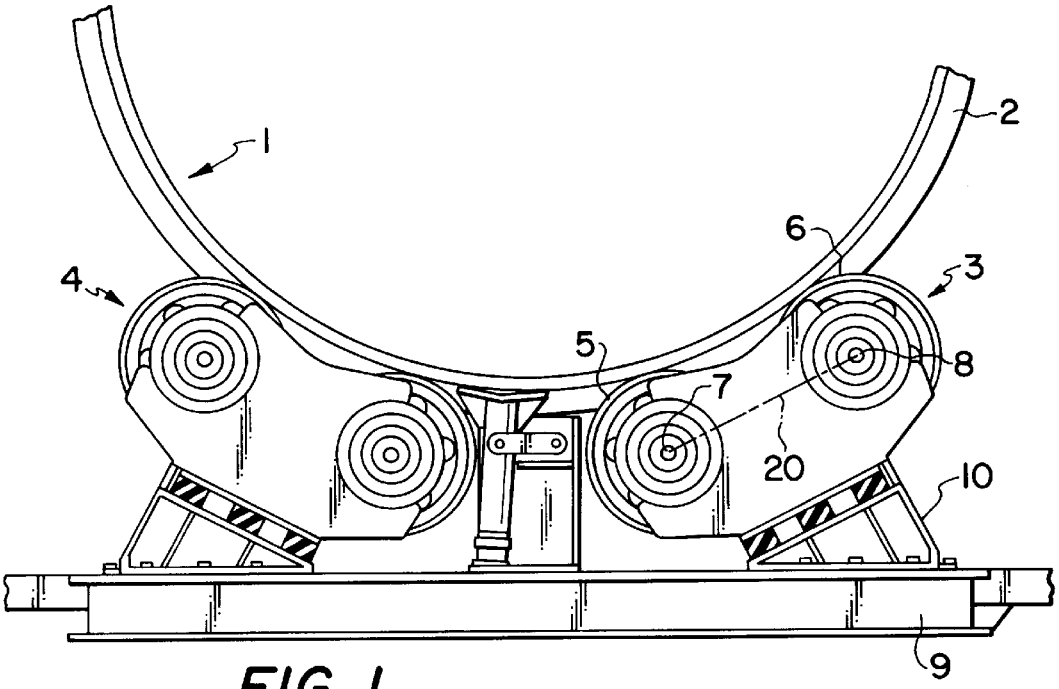
FIG. 1 shows a barking drum, placed on two bogies, both of which are arranged in one and the same foundation.
Figure 2:
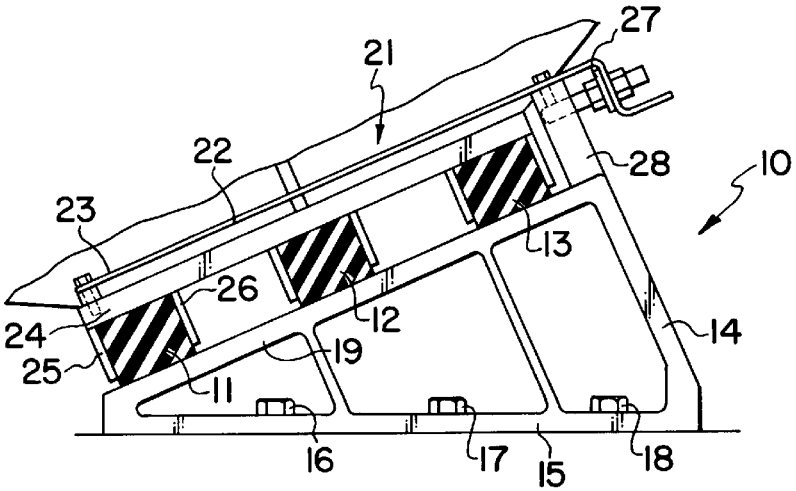
FIG. 2 shows the device according to the invention for fastening each one of the bogies to the foundation.

With reference to FIG. 1, the is shown there a barking drum which is an integral part of a barking unit, which drum is provided with a jacket surface 2 and is placed on two bogies 3, 4, which are arranged at a distance from each other in the circumferential direction of the drum. Each bogie comprises a travelling wheel 5 and a driving wheel 6, which are arranged at a distance from each other in the circumferential direction of the drum, and of which each one is rotatably arranged on a center axle 7, 8. These center axles 7, 8 have a direction which is substantially parallel with the longitudinal direction of the jacket surface 2 of the barking drum 1.

Each bogie is fastened to a foundation 9. According to the invention each bogie is resiliently arranged in the foundation by means of a device 10 which comprises elastic elements 11–13.

The device 10 comprises a frame 14, having a plane portion 15 directed towards the foundation 9, which portion is fastened to the foundation by means of bolts 16–18. The frame has further another plane portion 19, which has such a direction that the portion 19 is angled in relation to the portion 15 by about 30°. The portion 19 has a direction which is substantially parallel with a line 20, connecting the axle center 7 of the travelling wheel 5 with the center 8 of the driving wheel 6, all of the some device 10.

Each device 10, as has been mentioned previously, comprises elastic elements 11–13, which are three in number and are made of rubber and/or plastic. These three elements comprise three cushions, which are arranged at a distance from each other between the upper, plane portion 19 of the frame 10 and a plate arrangement 21. In this connection, the intermediate element 12 is more rigid than the two outer elements 11, 13, which preferably are substantially of equal rigidity. Furthermore, the distance between the intermediate element 12 and each respective outer element 11, 13 is substantially the same. This plate arrangement comprises a flexible, elongated plate 22, which is fastened to the bogie. The one end 23 of the plate 22 is in a suitable way fastened to a plate-like means 24, which is intended to be in contact with the topside of the three elastic elements 11–13. This plate-like means 24 is provided with two plate means 25, 26, which project downwards and are arranged on each side of each elements 11–13, whereby these elements are kept in place.

The other end 27 of the elongated plate 22 is fastened to the respective fame 14, and more exactly to a part 28, which projects upwards from the upper plane portion 19 of the respective frame, and which is arranged so as to be substantially vertically presented against the portion 19 at the very end of the portion 19.

Figure 3:
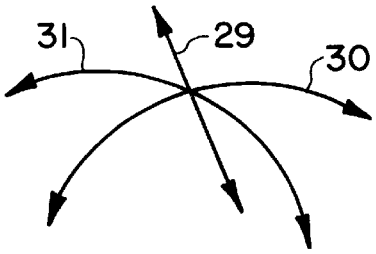
FIG. 3 shows the linear movement of the bogie.

Due to the mentioned design of the three elastic elements 11–13, the positioning of the three elastic elements 11–12 and the design of the plate arrangement 21, it is made possible for the bogies 3, 4 to carry out three different movements as depicted in FIG. 3, namely partly a linear movement 29 in a direction which is substantially vertical against the line 20, connecting the axle centers 7, 8 of the respective travelling wheel 5 and the driving wheel 6, partly a tilting movement 30 about an axis having a direction which is substantially perpendicular to the mentioned line 20 and substantially parallel with the longitudinal jacket surface of the barking drum 1, and finally a tilting movement 31 about an axis having a direction which is substantially parallel with the mentioned line 20. In this specific case, the mentioned axes go through the intermediate, elastic element 12.

Due to the fact that each bogie accordingly can be allowed to make these movements, the detrimental effects on the bogies are reduced, which otherwise could be the result of the high loads caused by the barking drum when rotating during work.

The invention is of course not limited to the described and shown embodiment but can be modified within the scope of the following claims.

I claim:

1. A debarking device, comprising:

a drum having a radically outer peripheral surface, the drum being arranged to be rotated about a longitudinal axis;

a foundation;

two bogies, spaced from one another in the circumferential direction of said outer peripheral surface of said drum, and supporting said drum from said foundation;

each bogie including a travelling wheel and a driving wheel, spaced from one another in the circumferential direction of said outer peripheral surface of said drum, and each journalled on respective axles for rotation about a respective axis which is substantially parallel to said longitudinal axis;

a respective structure interposed between each said bogie and said foundation, and via which said drum is supported by the respective bogie on said foundation;

each said structure including three elastic elements each comprising a respective cushion, said cushions being located beside one another in said circumferential direction, with spacing therebetween, so as to include an intermediate cushion and two outer cushions; said intermediate cushion being more rigid than said intermediate cushion;

each said structure further including a plate arrangement supporting a respective said bogie and being supported by the cushions of a respective said three elastic elements.

2. The debarking device of claim 1, wherein:

each said structure further comprises a frame having an upper portion supporting the respective said three elastic elements, and a lower portion supported on said foundation;

each said frame upper portion being slated to extend in a direction which is parallel to a line connecting said axles of said travelling and driving wheels of the respective said bogie, and each frame lower portion being disposed at an acute angle to the respective said frame upper portion.

3. The debarking device of claim 2, wherein each said plate arrangement comprises:

a flexible, elongated plate fastened to the respective bogie;

a plate means supported on the respective said three elastic elements;

said flexible, elongated plate having a first end portion fastened to said plate means and a second end portion fastened to said frame.

4. The debarking device of claim 3, wherein:

each said plate means includes a plurality of pairs of downwardly projecting elements which are respectively arranged beside respective ones of said three elastic for keeping respective ones of said three elastic elements in place.

5. The debarking device of claim 3, wherein:

each said frame upper portion includes an upstanding flange; and each said flexible, elongated plate second end portion is fastened to the respective said frame by being fastened to the respective said upstanding flange.

6. The debarking device of claim 1, wherein:

each of said three elastic elements is made of at least one of rubber and plastic material.

* * * * *